US008287088B2

(12) United States Patent
Iesaki

(10) Patent No.: US 8,287,088 B2
(45) Date of Patent: Oct. 16, 2012

(54) IMAGE FORMING APPARATUS

(75) Inventor: Kenichi Iesaki, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 412 days.

(21) Appl. No.: 12/622,238

(22) Filed: Nov. 19, 2009

(65) Prior Publication Data

US 2010/0123751 A1 May 20, 2010

(30) Foreign Application Priority Data

Nov. 19, 2008 (JP) ..... 2008-295774

(51) Int. Cl.
*B41J 29/38* (2006.01)
*B41J 23/00* (2006.01)

(52) U.S. Cl. ..... 347/37; 347/9; 347/14; 347/16

(58) Field of Classification Search ..... 347/9, 4–5, 347/14–16, 20, 37
See application file for complete search history.

(56) References Cited

U.S. PATENT DOCUMENTS 7,852,517 B2 * 12/2010 Takahashi ..... 358/420
2004/0227781 A1 * 11/2004 Kaburagi ..... 347/14

FOREIGN PATENT DOCUMENTS

JP 2001-063168 A 3/2001
JP 2008-040779 A 2/2008

* cited by examiner

*Primary Examiner* — Jason Uhlenhake
(74) *Attorney, Agent, or Firm* — Baker Botts L.L.P.

(57) ABSTRACT

An image forming apparatus includes a conveyance control unit that controls conveyance of a recording unit. The conveyance control unit switches a conveyance direction of the recording unit at return points on both sides of a scanning direction to reciprocate the recording unit, and controls a speed of the recording unit to a target speed until the recording unit reaches a control changeover point from the return point upstream in the conveyance direction. The target speed is set to be symmetrical in a zone in which the recording unit is shifted to a constant speed state from a start point of an image forming area and in a zone in which the recording unit reaches the end point of the image forming area from a deceleration start point.

12 Claims, 11 Drawing Sheets

ACTUAL SPEED IS DELAYED IN RISING AS COMPARED TO TARGET SPEED TRAJECTORY DUE TO STATIC FRICTION, AND THEREAFTER FOLLOWS TRAJECTORY

FIG. 10

PRIOR ART

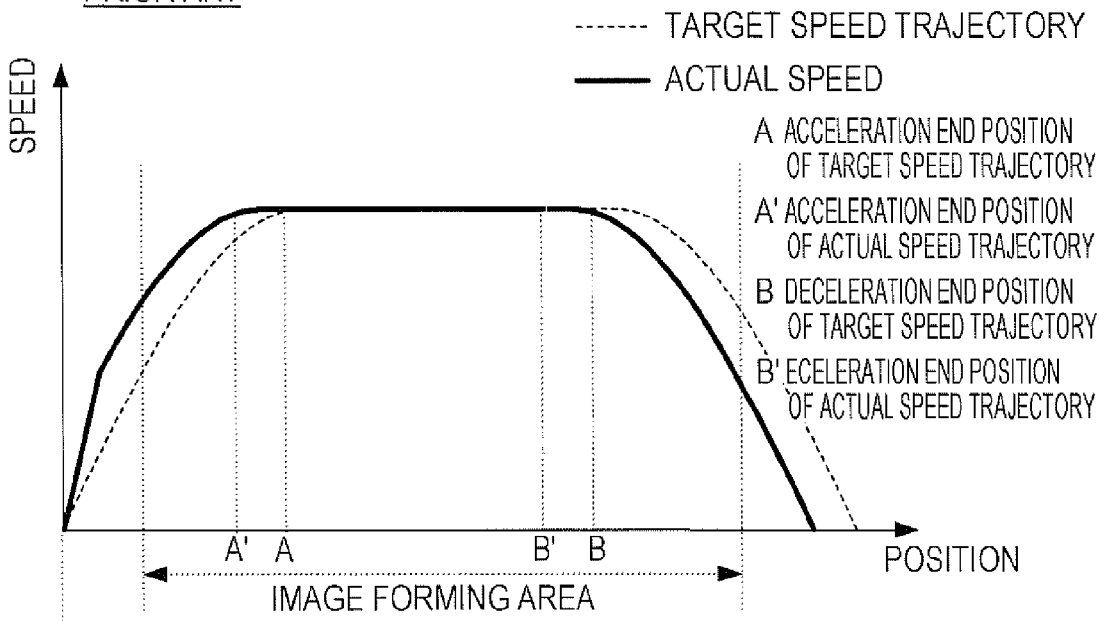

ACCELERATION DISTANCE IS SHORTENED AND SCANNING DISTANCE IS ALSO SHORTENED DUE TO STATIC FRICTION IN CASE OF SPEED CONTROL WITH FIXED TARGET SPEED TRAJECTORY. MOREOVER, SINCE SPEED TRAJECTORIES ARE NOT SYMMETRICAL IN IMAGE FORMING AREA, SPEED TRAJECTORIES WITH RESPECT TO POSITION TO AND FROM ARE NOT CONSISTENT.

PRESENT INVENTION

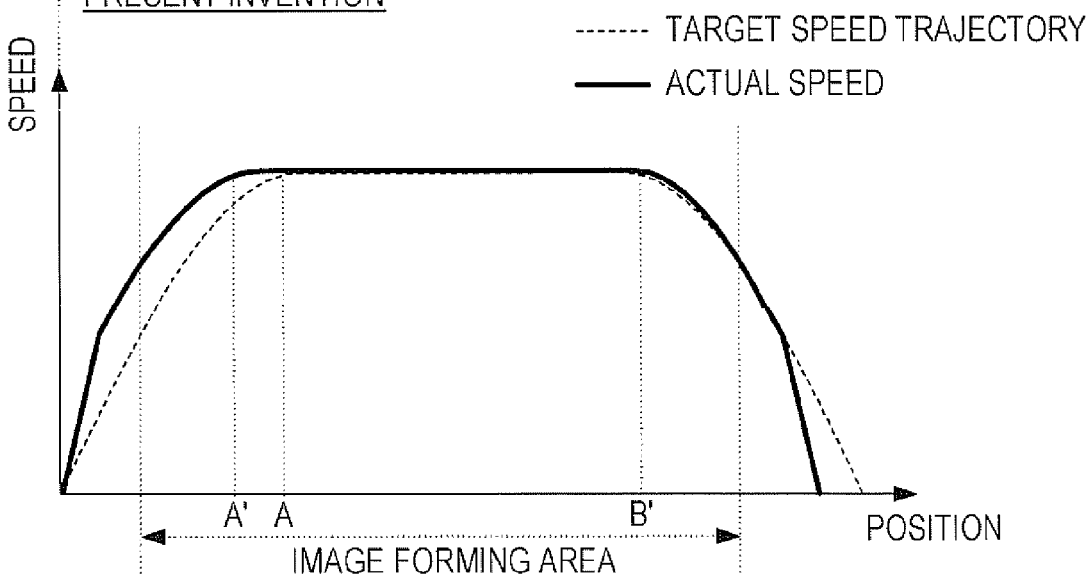

DECELERATION START POSITION IS SET TO B' IN ORDER TO HAVE DECELERATION DISTANCE EQUIVALENT TO DISTANCE FROM ACCELERATION START POSITON TO A'. THEREBY, SPEED TRAJECTORIES IN IMAGE FORMING AREA BECOMES SYMMETRICAL.

IMAGE FORMING APPARATUS

CROSS-REFERENCE TO RELATED APPLICATIONS

This application claims the benefit of Japanese Patent Application No. 2008-295774 filed Nov. 19, 2008 in the Japan Patent Office, the disclosure of which is incorporated herein by reference.

BACKGROUND

This invention relates to an image forming apparatus that conveys a recording unit in a main scanning direction and makes the recording unit eject ink drops during the conveyance of the recording unit, thereby to form an image onto a sheet passing in a sub-scanning direction.

An image forming apparatus according to an ink-jet recording method is conventionally known. In the image forming apparatus according to the ink-jet recording method, generally, a recording unit ejects ink drops while moving at a constant speed in a main scanning direction. Thereby, an image is formed onto a sheet passing in a sub-scanning direction.

Specifically, in the conventional image forming apparatus, ink drops are ejected while the recording unit is moved at a constant speed. As a result, misalignment of landing positions of the ink drops is avoided and a uniform image without unevenness is formed.

Also, in the image forming apparatus of this type, the recording unit reciprocates and ejects ink drops in each of the outward and homeward journeys, thereby to form an image onto a sheet at a high speed.

In case that an image forming operation is performed as described above in each of the outward and homeward journeys, it is necessary to accurately stop the recording unit at return points. Otherwise, a distance from a stop position to an image forming start position may fluctuate upon performing the image forming operation for the next line after the stop of the recording unit.

In a known technique for stopping the recording unit accurately at a target stop position which may solve the above problem, the recording unit is conveyed at a low speed before the target stop position, and control of the recording unit is switched from speed control to position control in a vicinity of the target stop position. In this manner, the recording unit is stopped at the target stop position with high precision.

SUMMARY

In the method of forming an image by making the recording unit eject ink drops while moving the recording unit at a constant speed in the main scanning direction, the recording unit has to be shifted to a constant speed state before entering an image forming area where ejecting operation of ink drops is performed. Moreover, since decelerating operation cannot be started after the recording unit moves out of the image forming area, there is limitation in shortening a conveyance path of the recording unit.

The present inventors have then come up with an idea of performing the image forming operation even during acceleration/deceleration of the recording unit, thereby to shorten the conveyance path of the recording unit in the main scanning direction and downsize the apparatus. In other words, the inventors have thought of reducing a length of the overall conveyance path by partly overlapping an acceleration/deceleration area with the image forming area.

In prior art, however, there is limitation of precision in control of ink landing positions during acceleration/deceleration. Thus, simply performing the image forming operation during acceleration/deceleration may achieve downsizing of the apparatus, but leads to deterioration in image quality.

It would be desirable that one aspect of the present invention provides, in an image forming apparatus that performs image forming operation during acceleration/deceleration in each of the outward and homeward journeys, a technique which inhibits deterioration in image quality due to misalignment of landing positions of ink drops and allows forming a high quality image onto a sheet.

After studying deterioration in image quality due to misalignment of landing position of ink drops, the inventors have recognized the following. That is, in the image forming apparatus that performs the image forming operation during acceleration/deceleration in each of the outward and homeward journeys, a speed trajectory with respect to position (i.e., a speed trajectory formed by plotting a speed at each position in a two-dimensional coordinate system having position and speed as dimensions) during acceleration and a speed trajectory with respect to position during deceleration are formed symmetrical, and speed trajectories with respect to position of the recording unit in the respective outward and homeward journeys are made to conform to each other. In this manner, it is possible to inhibit deterioration in image quality due to misalignment of landing positions of ink drops between respective scanning lines.

The landing form of ink drops depends on the speed of the recording unit. In an area where the image forming is conducted while the recording unit is accelerated in the outward journey, image formation is conducted while the recording unit is decelerated in the homeward journey, in case that the image forming operation is performed in each of the outward and homeward journeys during acceleration/deceleration.

Accordingly, in case that the speed trajectory with respect to position during acceleration and the speed trajectory with respect to position during deceleration are not formed symmetrical in an image forming area which is an area in the conveyance path where the recording unit performs the image forming operation, change in speed of the recording unit during image formation is different between adjacent lines.

Thus, in case that the speed trajectory with respect to position during acceleration and the speed trajectory with respect to position during deceleration are not formed symmetrical, misalignment of landing positions of ink drops between the adjacent lines becomes conspicuous. As a result, image quality of an image formed onto a sheet is deteriorated.

In prior art in which a target speed trajectory with respect to time (i.e., a speed trajectory formed by plotting a speed at each time in a two-dimensional coordinate system having time and speed as dimensions) is fixed, it is not possible to form, in the image forming area, the speed trajectory with respect to position during acceleration and the speed trajectory with respect to position during deceleration to be symmetrical and conform the speed trajectories with respect to position of the recording unit in the outward and homeward journeys to each other.

Because, as shown in FIG. 9, the actual speed of the recording unit is delayed in rising as compared to the target speed trajectory due to a static friction characteristic, and thereafter follows the target speed trajectory. Accordingly, even if the actual speed follows the target speed trajectory with respect to time, a trajectory of the actual speed with respect to position goes off the target speed trajectory, as shown in FIG. 10.

In other words, speeds in the respective positions of the recording unit during acceleration become larger than expected from the target speed trajectory. Since the recording unit is shifted to a constant speed state in as short a distance as that, an acceleration distance becomes short.

In other words, in case that speed control is performed with the fixed target speed trajectory, the overall scanning distance of the carriage becomes short as much as the acceleration distance becomes short, as shown in the upper part of FIG. 10. On the other hand since there is no delay during deceleration due to static friction which occurs during acceleration, the acceleration distance and the deceleration distances become different. The speed trajectories with respect to position are not consistent in the outward and homeward journeys.

Therefore, when the ejection operation of ink drops is performed during acceleration/decoration in prior art, misalignment of landing positions of ink drops become conspicuous between the lines, which leads to nonuniformity in image quality.

Thus, it would be desirable to constitute the image forming apparatus as below upon performing the image forming operation in each of the outward and homeward journeys even during acceleration/deceleration, so that deterioration in image quality due to misalignment of the landing positions of ink drops is suppressed and a high quality image can be formed onto a sheet.

An image forming apparatus in one aspect of the present invention includes a recording unit, a conveyance mechanism, a position detecting unit, an image forming control unit, and a conveyance control unit. The recording unit is configured to eject ink drops. The conveyance mechanism conveys the recording unit in a main scanning direction by a driving force of a motor provided in the conveyance mechanism. The position detecting unit detects the position in a conveyance path of the recording unit. The image forming control unit makes the recording unit eject ink drops during conveyance of the recording unit thereby to form an image onto a sheet passing an ejection position of the ink drops in a sub-scanning direction.

The conveyance control unit drives the motor to control conveyance of the recording unit. Also, the conveyance control unit switches a conveyance direction of the recording unit to a reverse direction at return points on both sides of the main scanning direction in a conveyance path of the recording unit so as to reciprocate the recording unit. The conveyance control unit also operates as follows.

Specifically, the conveyance control unit controls a speed of the recording unit to a target speed from the return point upstream in the conveyance direction until the recording unit reaches a predetermined control changeover point downstream in the conveyance direction. After the recording unit has reached the control changeover point, the conveyance control unit controls a position of the recording unit to a target position from the control changeover point until the recording unit reaches the return point downstream in the conveyance direction.

Through the above-described speed control and position control, the conveyance control unit conveys the recording unit at a constant speed after accelerated from the return point upstream in the conveyance direction. After "the recording unit has reached a point located upstream in the conveyance direction by a distance required for acceleration from the return point downstream in the conveyance direction", the conveyance control unit decelerates the recording unit so as to control the recording unit to stop at the return point downstream in the conveyance direction.

The conveyance control unit defines a constant speed moving area, which is an area in the conveyance path in which the conveyance control unit moves the recording unit at a constant speed, to be a smaller area than an image forming area which is the area in the conveyance path in which image forming operation by the image forming control unit is performed.

The conveyance control unit defines the control changeover point to be one of an end point downstream in the conveyance direction of the image forming area and a point downstream in the conveyance direction of the end point.

The conveyance control unit sets the target speed such that, in an acceleration zone starting from a start point upstream in the conveyance direction of the image forming area to where the recording unit is shifted to a constant speed state, and in a deceleration zone starting from the deceleration start point to where the recording unit reaches the end point downstream in the conveyance direction of the image forming area, a speed trajectory of the recording unit is symmetrical with respect to an axis of a speed direction in a two-dimensional coordinate system having position and speed as dimensions. The axis of the speed direction passes a midpoint between an end point of the acceleration zone and the deceleration start point which is a start point of the deceleration zone.

According to the image forming apparatus, deterioration in image quality due to misalignment of landing positions of ink drops can be suppressed. A high quality image can be formed onto a sheet.

BRIEF DESCRIPTION OF THE DRAWINGS

The invention will now be described below, by way of example, with reference to the accompanying drawings, in which:

FIG. 10 is diagram showing comparison between prior art and the present invention.

DETAILED DESCRIPTION OF THE PREFERRED EMBODIMENT

An embodiment of the present invention will be described hereinafter by way of drawings.

Figure 1:
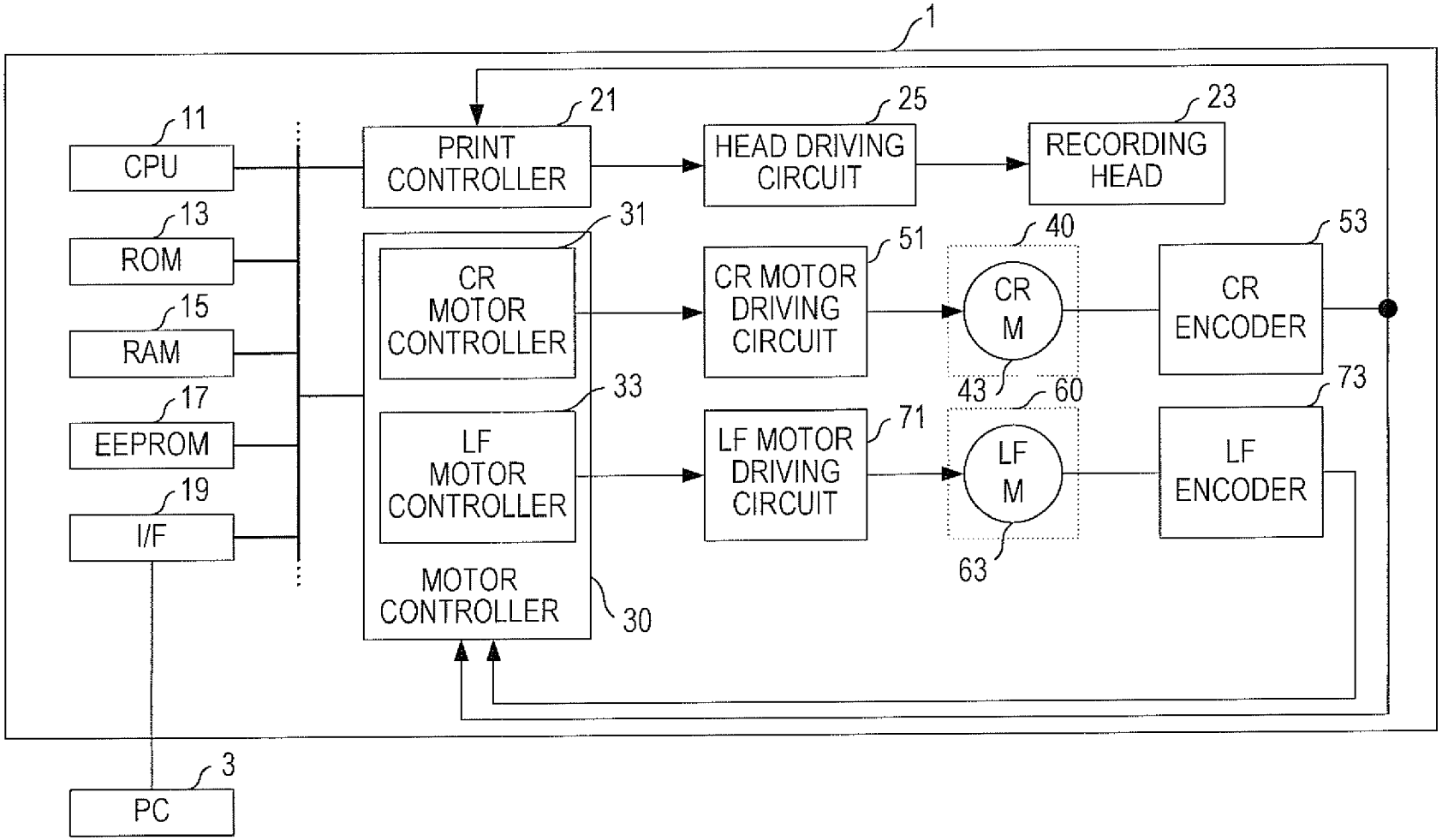
FIG. 1 is a block diagram showing a constitution of a printer apparatus according to an embodiment of the present invention.

A printer apparatus 1 of the present embodiment, as shown in FIG. 1, includes a CPU 11, a ROM 13, a RAM 15, an EEPROM 17, an interface 19 (USB interface, for example), a print controller 21, and a motor controller 30. The ROM 13 stores programs and others executed by the CPU 11. The RAM 15 is used as a work area during execution of the programs. The EEPROM 17 stores various setting information. The interface 19 receives a print command transmitted from a personal computer (PC) 3 and print data transmitted together with the print command.

The printer apparatus 1 also includes a recording head 23, a head driving circuit 25, a carriage conveyance mechanism 40, a sheet conveyance mechanism 60, a CR motor driving circuit 51, a CR encoder 53, a LF motor driving circuit 71, and a LF encoder 73. The recording head 23 includes a plurality of nozzles for ejecting ink drops arranged thereon. The head driving circuit 25 drives the recording head 23. The CR motor driving circuit 51 drives a CR motor 43 provided in the carriage conveyance mechanism 40. The CR encoder 53 outputs pulse signals in accordance with a position of the carriage 41 driven by the CR motor 43. The LF motor driving circuit 71 drives a LF motor 63 provided in the sheet conveyance mechanism 60. The LF encoder 73 is a rotary encoder that outputs pulse signals each time the LF motor 63 rotates a predetermined angle.

Figure 2:
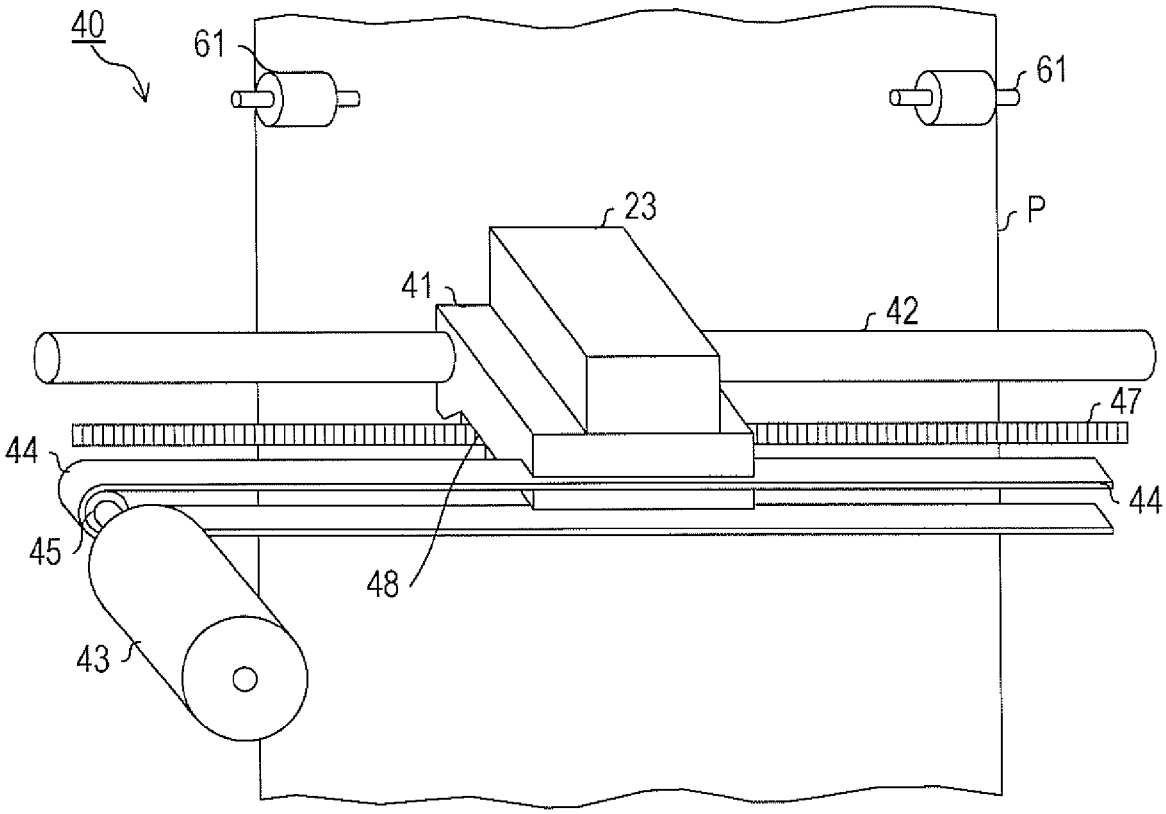
FIG. 2 is a perspective view showing a constitution of a carriage conveyance mechanism.

The carriage conveyance mechanism 40, as shown in FIG. 2, includes a carriage 41, the CR motor 43, and others. The carriage 41 conveys the recording head 23 in a main scanning direction. The CR motor 43 is a direct current motor for moving the carriage 41 in the main scanning direction. The carriage 41 is connected to an endless belt 44 and set so as to be able to move in the main scanning direction along a guide shaft 42. FIG. 2 is a perspective view showing a constitution of the carriage conveyance mechanism 40 provided in the printer apparatus 1.

Figure 4:
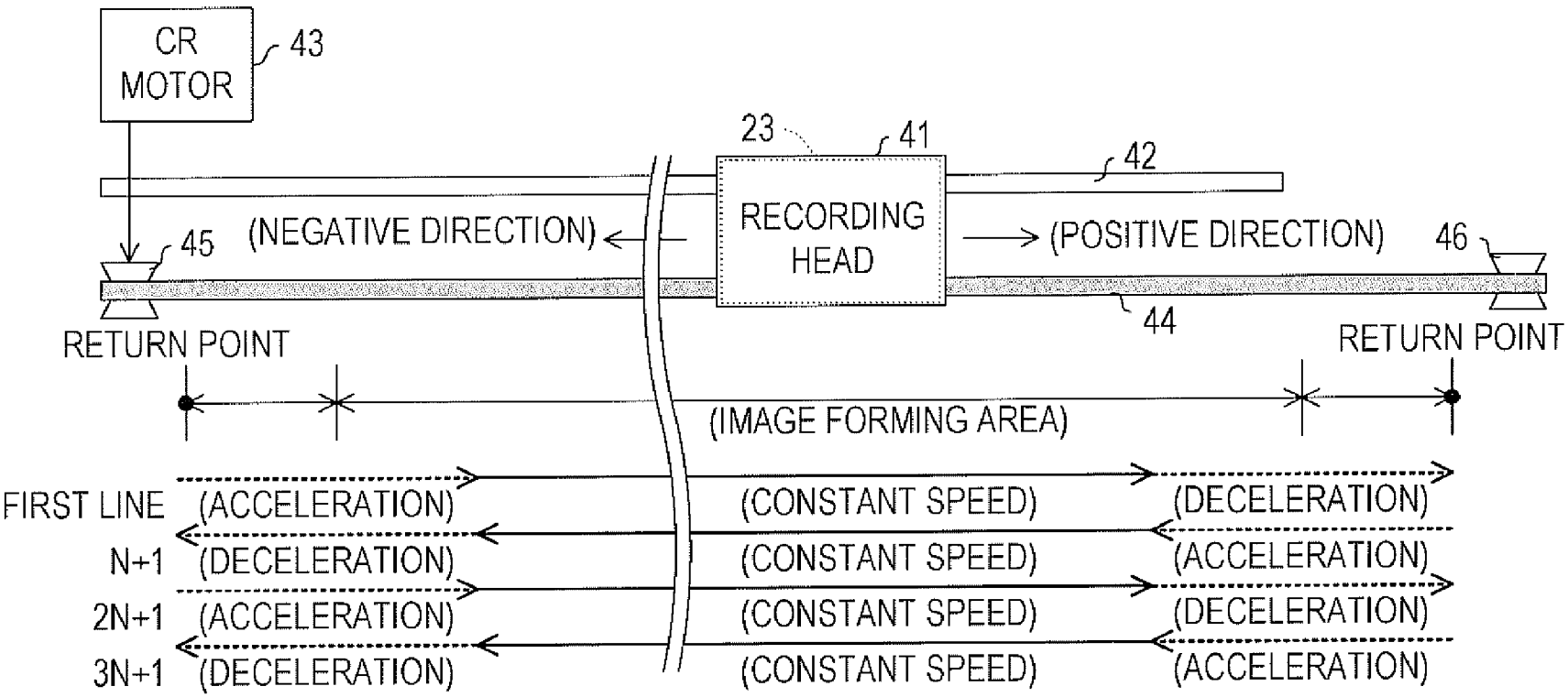
FIG. 4 is an explanatory view showing a conveyance state of a carriage during execution of the print control process.

In the carriage mechanism 40, the endless belt 44 is held between a pulley 45 provided on a rotation shaft of the CR motor 43 and an idle pulley 46 (see FIG. 4). The endless belt 44 receives a rotation force of the CR motor 43 via the pulley 45 and rotates.

Specifically, the carriage conveyance mechanism 40 is configured such that the endless belt 44 rotates in receipt of the rotation force of the CR motor 43 and thereby the carriage 41 moves in the main scanning direction along the guide shaft 42 constituting a carriage conveyance path.

The printer apparatus 1 further includes a timing slit 47 on which slits are formed at constant minute intervals along the guide shaft 42. A sensor element 48 is provided in the carriage 41 to detect the slits formed on the timing slit 47 and output pulse signals corresponding to the position of the carriage 42. In other words, the timing slit 47 and the sensor element 48 constitute the CR encoder 53 as a linear encoder in the present embodiment.

The recording head 23 is constituted as a known piezo type inkjet head. When a driving voltage is applied, the recording head 23 deforms its piezoelectric portion adjacent to an ink chamber to change the volume of the ink chamber. As a result, ink inside the ink chamber is ejected toward a sheet from the nozzles. The recording head 23 is mounted on the carriage 41, and moves in the main scanning direction by being conveyed by the carriage 41.

The sheet conveyance mechanism 60 includes a conveyance roller 61, the LF motor 63, and others. The conveyance roller 61 conveys a sheet P in a sub-scanning direction. The LF motor 63 is a direct current motor for rotating the conveyance roller 61. The sheet conveyance mechanism 60 rotates the conveyance roller 61 using the LF motor 63, thereby to convey the sheet P toward an area located downward of the recording head 23 and facing the nozzles of the recording head 23 in the sub-scanning direction orthogonal to the main scanning direction.

The print controller 21, when starting operation in response to a command from the CPU 11, controls the recording head 23 through the head driving circuit 25, based on pulse signals input from the CR encoder 53 and image data input from the CPU 11, to form an image corresponding to the image data input from the CPU 11 onto the sheet P passing an ejection position of ink drops in the sub-scanning direction. Particularly, the print controller 21 applies a driving voltage to the recording head in synchronous with the move of the carriage 41 based on the pulse signals input from the CR encoder 53, thereby to make the recording head 23 eject ink drops from the nozzles, as in a known printer apparatus.

The motor controller 30 includes a CR motor controller 31 and a LF motor controller 33. The motor controller 30, when starting operation in response to a command from the CPU 11, controls the CR motor 43 through the CR motor controller 31 and controls the LF motor 63 through the LF motor controller 33.

Specifically, the CR motor controller 31, when operating in response to the command from the CPU 11, detects a moving speed (actual speed) Vm of the carriage 41 based on the pulse signals input from the CR encoder 53, and controls the moving speed of the carriage 41 so that the detection speed Vm is consistent with a target speed Vr. The CR motor 31 then moves the carriage 41 at the target speed Vr in a conveyance direction specified by the CPU 11 (details will be described later).

The LF motor controller 33, when operating in response to a command from the CPU 11, controls the LF motor 63 so as to send out the sheet P by an amount specified by the CPU 11. Particularly, the LF motor controller 33 determines a manipulated variable for the LF motor 63 based on the pulse signals input from the LF encoder 73. The LF motor controller 33 then controls the LF motor 63 so that the sheet P is sent out by the specified amount according to the manipulated variable.

Figure 3:
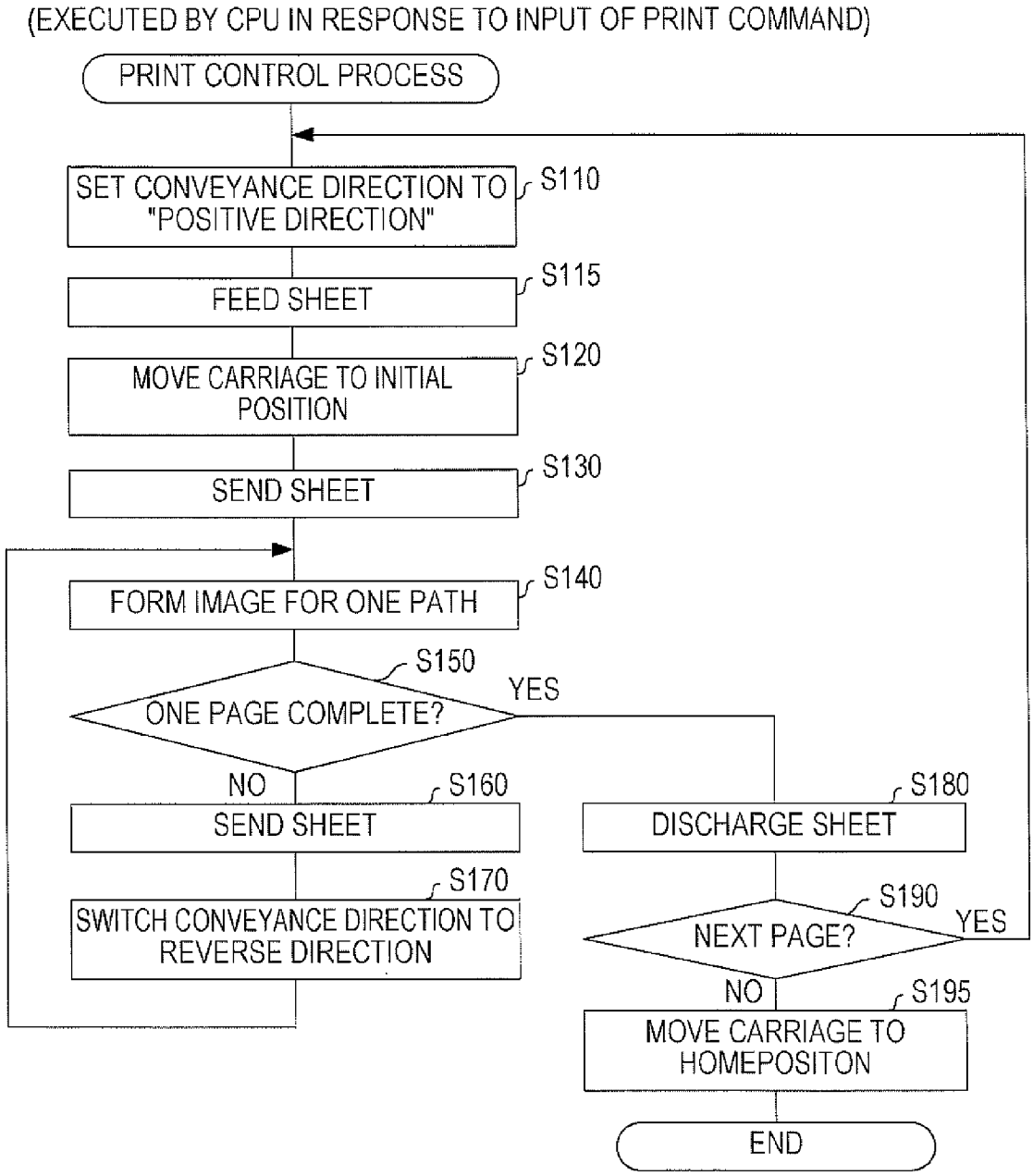
FIG. 3 is a flowchart illustrating a print control process executed by a CPU.

FIG. 3 is a flowchart showing a print control process executed by the CPU 11 upon receipt of a print command from the PC 3 through an interface 19. The motor controller 30 controls the CR motor 43 and the LF motor 63 in response to a command input when the CPU 11 starts the print control process.

When the print control process is started, the CPU 11 sets the conveyance direction of the carriage 41 to a "positive direction" (S110), and makes the sheet conveyance mechanism 60 execute feeding operation of the sheet P (S115). Moreover, the CPU 11 provides a command to the CR motor controller 31 to move the carriage 41 located at a home position to an initial position upstream in the "positive direction" in the carriage conveyance path (S120).

The CPU 11 also provides a command to the LF motor controller 33 so that the sheet P is conveyed in the sub-scanning direction until the head of a print area (head in the sub-scanning direction of the area on which printing is performed) in the fed sheet P reaches an ink ejection position below the recording head 23 (S130).

The CR motor controller 31 has a function of detecting the position Xm of the carriage 41 in the carriage conveyance path based on the pulse signals input from the CR encoder 53. Hereinafter, the direction in which the value of the position Xm detected by the CR motor controller 31 is increased in a coordinate system of the position Xm is expressed as the "positive direction". The direction in which the value of the position Xm is decreased is expressed as a "negative direction". The carriage 41 is regulated by the guide shaft 42 constituting the carriage conveyance path and moves one dimensionally in the main scanning direction. Thus, the conveyance direction of the carriage 41 is either the "positive direction" or the "negative direction".

After S130, the CPU 11 provides a command to the print controller 21 and the CR motor controller 31 thereby to make the print controller 21 and the CR motor controller 31 execute image forming operation for one path (S140).

The "image forming operation for one path" indicates an operation of moving the carriage in the main scanning direction for one way and making the recording head 23 eject ink drops during the move thereby to form an image for a predetermined number of lines onto the sheet P. The number of lines for which an image can be formed by the "image forming operation for one path" depends on the performance of the recording head. In the present embodiment, the recording head 23 is assumed to be capable of forming an image for N lines, where N is a value 1 (N=1), for example.

In details, in S140, an image forming start position and an image forming end position in the carriage conveyance path are specified for the print controller 21. Also, image data to form an image between the image forming start position and the image forming end position is supplied to the print controller 21, thereby to make the print controller 21 control the recording head 23 through the head driving circuit 25. While the carriage 41 moves from the image forming start position to the image forming end position, the recording head 23 executes ejection operation of ink drops corresponding to the image data along with the move of the carriage 41.

The image forming start position and the image forming end position are prefixed per size of the sheet P and the conveyance direction of the carriage 41. The information is stored in the ROM 13. Particularly, the image forming start position is defined to be a position corresponding to an end point upstream in the conveyance direction in an area of the carriage conveyance path facing the sheet P when the sheet P passes below the carriage conveyance path in the sub-scanning direction. The image forming end position is defined to be a position corresponding to an end point downstream in the conveyance direction in an area of the carriage conveyance path facing the sheet P when the sheet P passes below the carriage conveyance path in the sub-scanning direction.

In addition, the initial position where the carriage 41 is disposed in S120 is predefined at a position upstream in the conveyance direction by a predetermined distance D1 of the image forming start position when the conveyance direction is the "positive direction".

For the CR motor controller 31, the conveyance direction set in S110 or in S170 is specified as the conveyance direction of the carriage 41. A target stop position Xe of the carriage 41 is also specified so as to make the CR motor controller 31 convey the carriage 41 in the above-specified conveyance direction and control the CR motor 43 so that the carriage 41 stops at the target stop position Xe.

The target stop position Xe is predefined per size of the sheet P and the conveyance direction of the carriage 41. The information is stored in the ROM 13. Particularly, the target stop position Xe, when the conveyance direction is the "negative direction", is defined at the initial position where the carriage 41 is disposed in S120. The target stop position Xe, when the conveyance direction is the "positive direction", is defined at a position downstream in the conveyance direction of the image forming end position by the above-mentioned distance D1.

When the image forming operation for one path is complete in S140, the process moves to S150 to determine whether or not the image forming operation for one page is complete. When it is determined that the image forming operation for one page is not complete (S150: No), the process moves to S160.

In S160, the CPU 11 provides a command to the LF motor controller 33 to make the LF motor controller 33 convey the sheet P downstream in the sub-scanning direction for a distance of one path through the sheet conveyance mechanism 60. The "distance for one path" here corresponds to a length in the sub-scanning direction of an image capable of being formed onto the sheet P by the "image forming operation for one path".

After S160, the CPU 11 sets the conveyance direction to a reverse of the currently set direction. Specifically, if the current setting is the "positive direction", the conveyance direction is set to the "negative direction, and if the current setting is the "negative direction", the conveyance direction is set to the "positive direction (S170).

Thereafter, the process moves to S140. The CPU 11 makes the print controller 21 and the CR motor controller 31 execute the above-described "image forming operation for one path". After this step, the process moves to S150 to determine whether or not the image forming operation for one page is complete. If not, the process moves to S160 and repeats the same steps.

Specifically, the CPU 11, as shown in FIG. 4, makes the carriage 41 reciprocate in the main scanning direction through the CR motor controller 31. FIG. 4 is an explanatory view showing a conveyance state of the carriage 41 during the execution of the print control process. When the carriage 41 moves above the sheet P in the main scanning direction, ink drops are ejected from the recording head 23 by the operation of the above-described print controller 21. Thereby, an image based on the image data received from the PC 3 together with the print command is formed onto the sheet P.

When it is determined that the image forming operation for one page is complete (S150: Yes), the process moves to S180 to make the sheet conveyance mechanism 60 execute discharge operation of the sheet P (S180). After S180, it is determined whether or not there is image data for the next page (S190). When it is determined that there is image data for the next page (S190: Yes), the process moves to S110. Image formation of the next page is executed in the same manner as described above. If it is determined that there is no image data for the next page (S190: No), the CPU 11 provides a command to the CR motor controller 31 to make the carriage 41 move to the home position (S195). Then, the print control process is ended.

In the conventional apparatus, an area having a length sufficient for acceleration and deceleration is provided ahead and after an image forming area so that the carriage 41 can be moved at a constant speed in the image forming area. However, in this manner, the carriage conveyance path becomes long.

Accordingly, in the present embodiment, image formation is performed onto the sheet P as follows. In the vicinity of the image forming start position, the ejection operation of ink drops is performed in a state that the carriage 41 is accelerated. In the vicinity of image forming end position, the ejection operation of ink drops is performed in a state that the carriage 41 is decelerated. By constituting the printer apparatus 1 as such, the carriage conveyance path is shortened and the printer apparatus 1 is downsized.

Specifically, the conventional premise that the carriage 41 is conveyed at a constant speed inside the image forming area is not adopted. The distance D1 is defined in such a manner as to be shorter than a distance expected that the carriage 41 moves until shifted to a constant speed state (a theoretical distance obtained by integration of the target speed until the target speed is switched from zero to a constant speed). Thereby, the carriage 41 is accelerated/decelerated around the start point and end point of the image forming area as shown in FIG. 4.

However, merely performing the image forming operation during acceleration/deceleration can achieve downsizing of the apparatus but causes deterioration in image quality.

Figure 5:
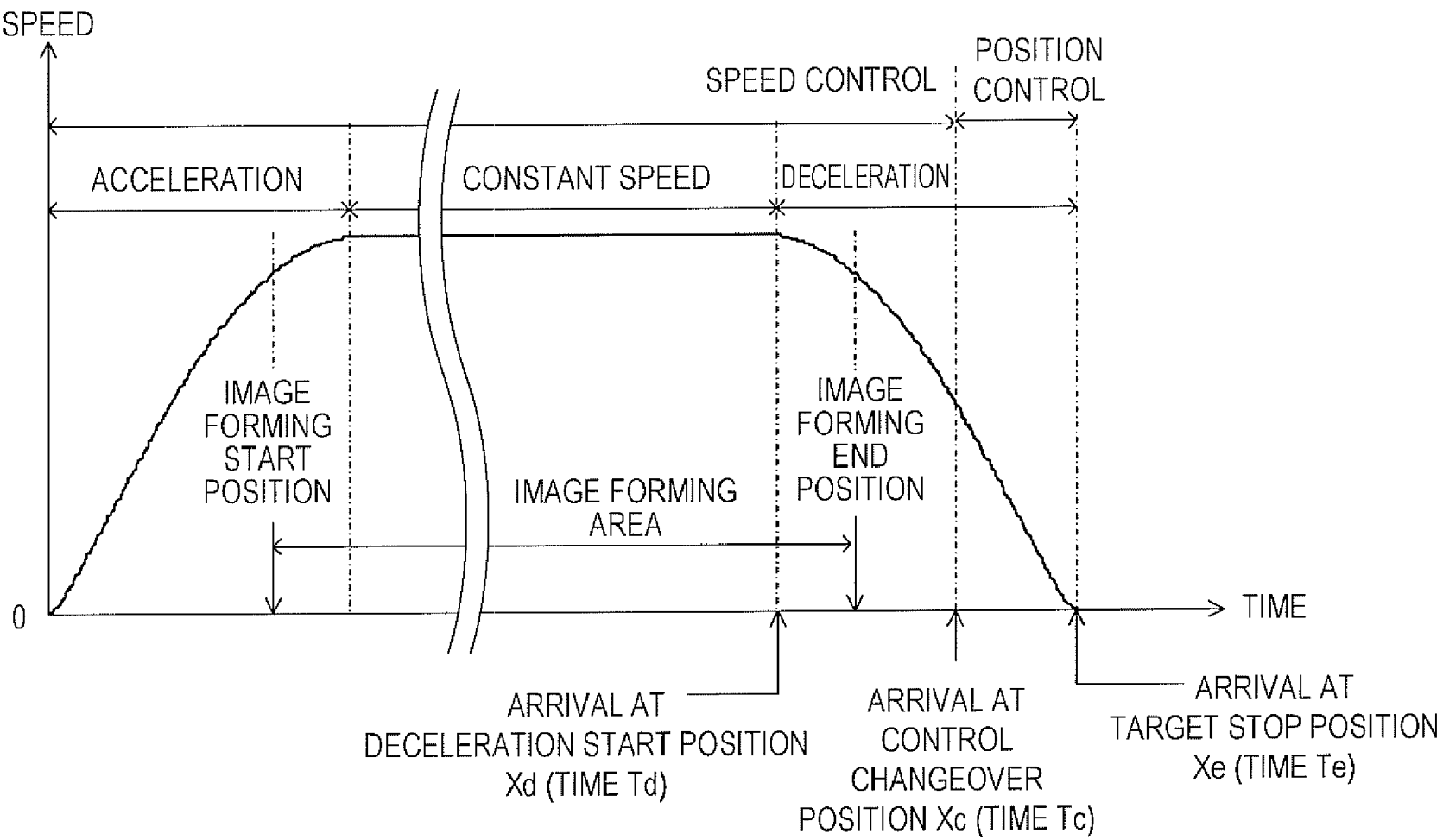
FIG. 5 is a graph showing a speed trajectory of the carriage in the printer apparatus.

In the present embodiment, as shown in FIG. 5, a target speed trajectory is set so as to suppress deterioration in image quality.

Particularly, in the present embodiment, an acceleration distance which is a distance the carriage 41 moves from a stop position before acceleration until being shifted to a constant speed state is figured out, when the carriage 41 is shifted to the constant speed state. A position located the acceleration distance upstream of the target stop position Xe is set as a deceleration start point Xd.

The speed of the carriage 41 is controlled in accordance with a target speed trajectory which has a line-symmetric relation in terms of time with the target speed trajectory during acceleration, when the carriage 41 reaches the deceleration start point Xd. Thereby, the carriage 41 is decelerated along a speed trajectory symmetrical to a speed trajectory during acceleration.

Moreover, control of the carriage 41 is switched from speed control to position control at a control changeover point Xc which is a position located a predetermined distance upstream of the target stop position Xe. Thereby, the carriage 41 is stopped at the target stop position Xe with precision.

Particularly, when the carriage 41 reaches the control changeover point Xc, a target position trajectory is set to be a quadratic function in which a first order temporal differentiation at the target stop position Xe is equal to zero, in consideration of the speed of the carriage 41 at the control changeover point Xc. Thereby, the carriage 41 is stopped at the target stop position Xe with precision.

As noted above, in the present embodiment, the speed trajectory during acceleration and the speed trajectory during deceleration with respect to position are set to be formed symmetrical, so that the speed trajectories with respect to position of the recording head 23 are uniform. In this manner, deterioration in image quality is suppressed.

Figure 6:
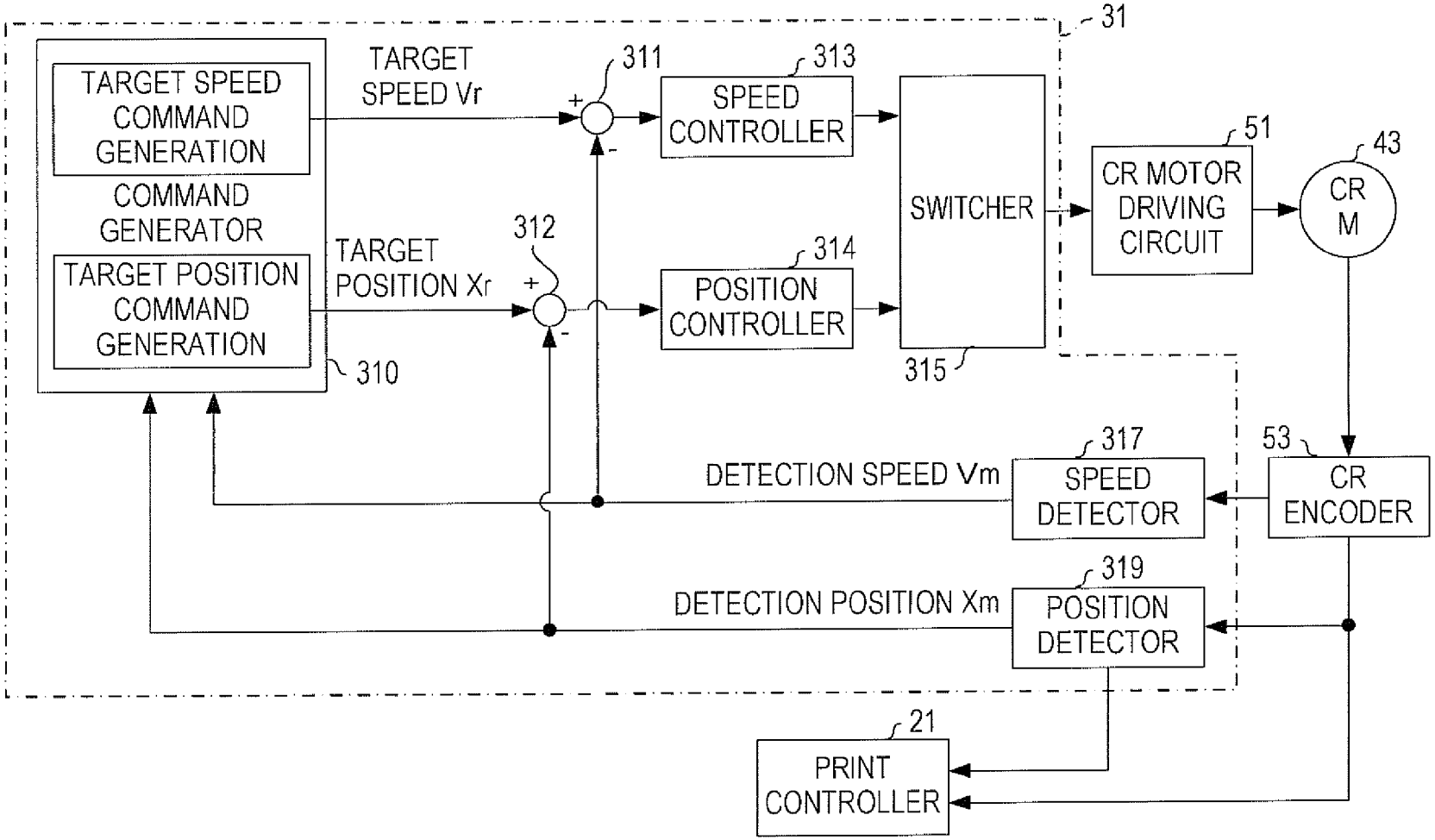
FIG. 6 is a functional block diagram showing a constitution of a CR motor controller.
Figure 7A:
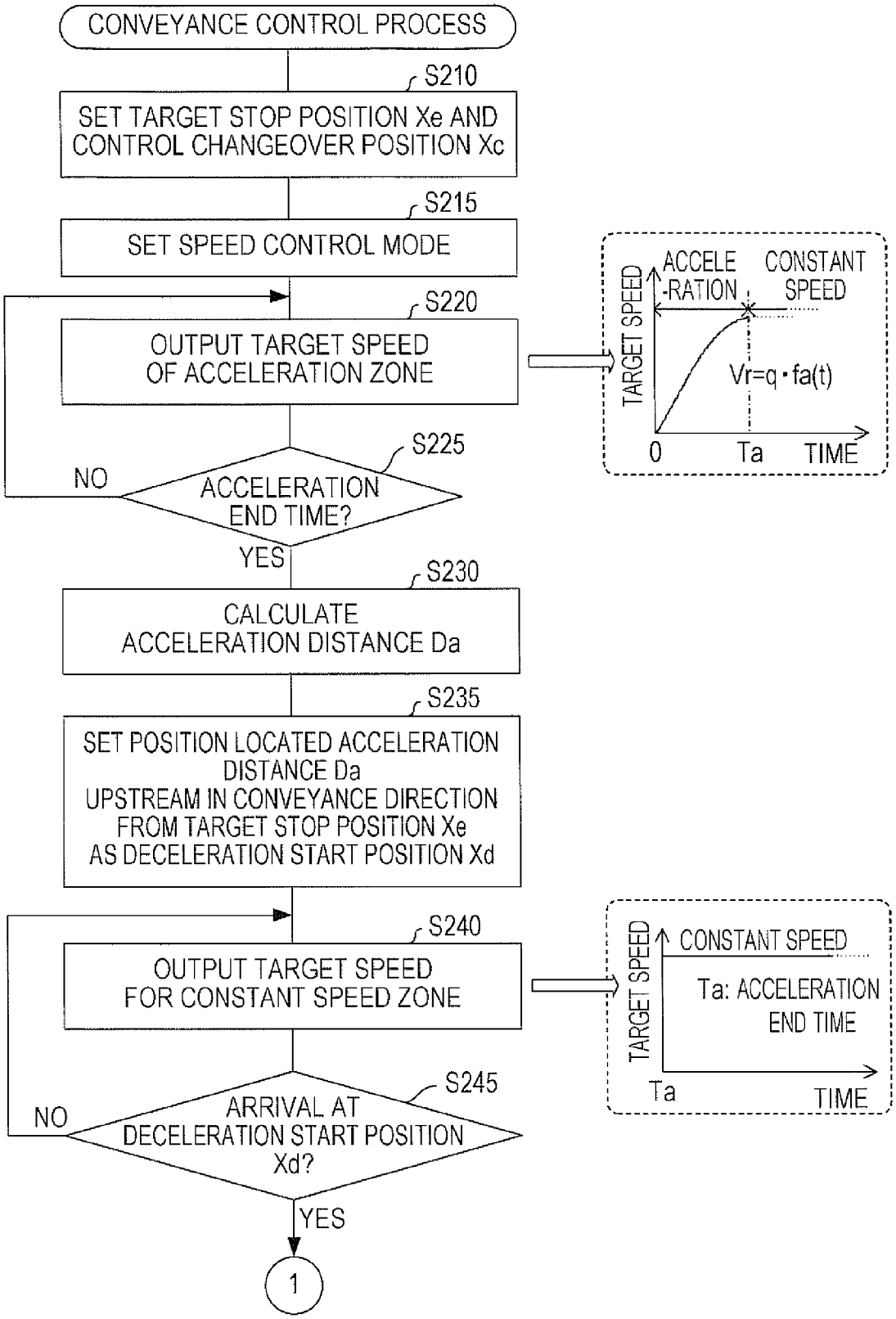
FIG. 7A and FIG. 7B are flowcharts showing a conveyance control process executed by a command generator.
Figure 7B:
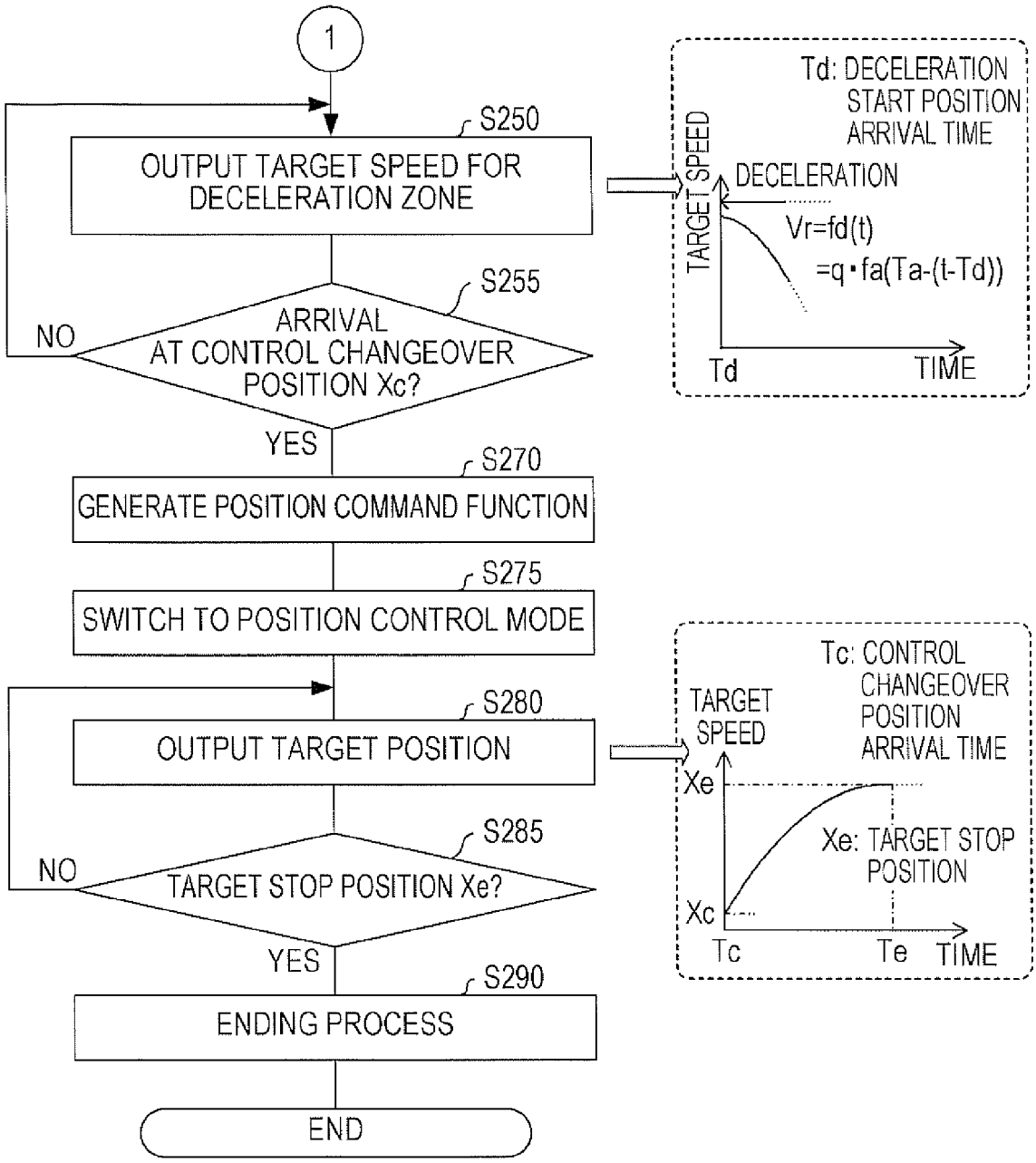
Figure 8:
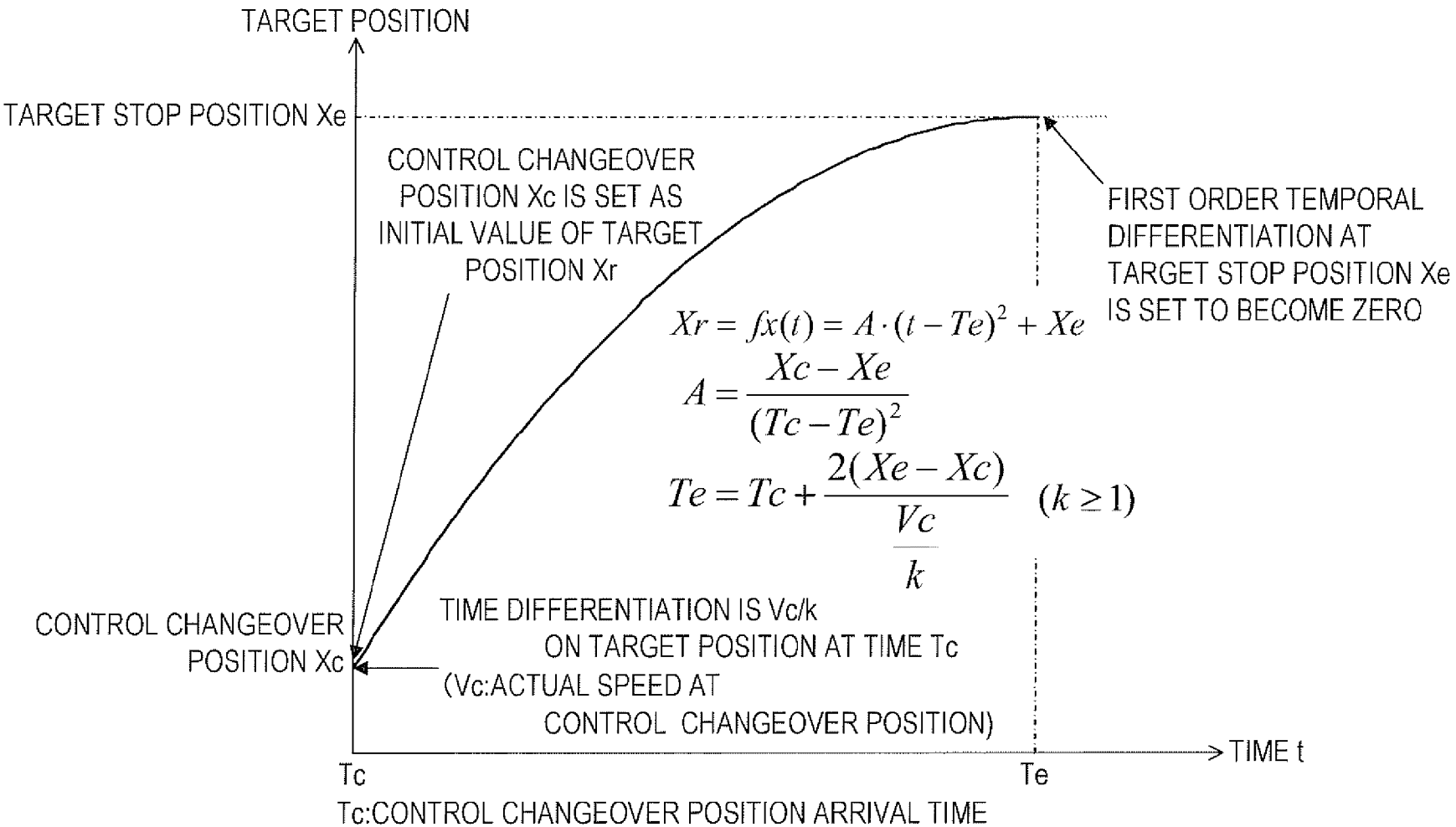
FIG. 8 is a graph showing a position command function fx(t)
Figure 9:
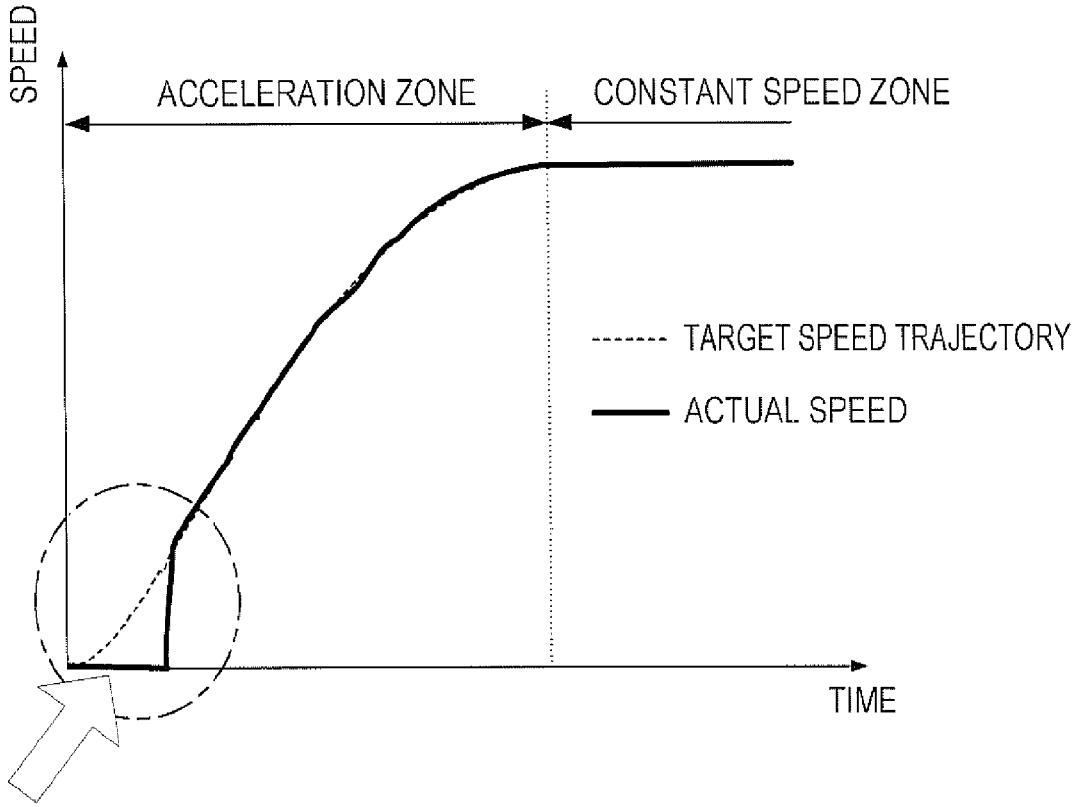
FIG. 9 is an explanatory view concerning prior art.

Now, the constitution of the CR motor controller 31 which achieves the above operation will be explained by way of FIGS. 6-8. FIG. 6 is a functional block diagram showing a constitution of the CR motor controller 31.

As shown in FIG. 6, the CR motor controller 31 includes a command generator 310, subtracters 311, 312, a speed controller 313, a position controller 314, a switcher 315, a speed detector 317, and a position detector 319.

The command generator 310 outputs either a target speed Vr or a target position Xr. Detailed operation of the command generator 310 will be described later by way of FIGS. 7A-7B.

The subtracter 311 subtracts the target speed Vr output from the command generator 310 by a detection speed Vm of the carriage 41 output from the speed detector 317 to figure out a deviation V=Vr Vm. The deviation V is input to the speed controller 313.

The subtracter 312 subtracts the target position Xr output from the command generator 310 by a detection position Xm of the carriage 41 output from the position detector 319 to figure out a deviation X=Xr Xm. The deviation X is input to the position controller 314.

The speed controller 313 passes the deviation V input from the subtracter 311 to a predetermined transfer function Gv to figure out a manipulated variable Uv for the CR motor 43. The manipulated variable Uv is output to the switcher 315. The transfer function Gv calculates the manipulated variable Uv which is intended to reduce the deviation V. The transfer function Gv is designed in a known method.

The position controller 314 passes the deviation X input from the subtracter 312 to a predetermined transfer function Gx to figure out a manipulated variable Ux for the CR motor 43. The manipulated variable Ux is output to the switcher 315. The transfer function Gx calculates the manipulated variable Ux which is intended to reduce the deviation X. The transfer function Gx is designed in a known method.

The switcher 315 selectively outputs either one of the manipulated variable Uv and the manipulated variable Ux to the CR motor driving circuit 51. Particularly, the switcher 315 outputs one of the manipulated variable Uv and the manipulated variable Ux to the CR motor driving circuit 51 according to a command from the command generator 310.

The CR motor driving circuit 51 drives the CR motor 43 by a driving voltage (or a driving current) corresponding to the manipulated variable Uv or the manipulated variable Ux input from the switcher 315. Thereby, the carriage 41 moves in the carriage conveyance path in the "positive direction" or the "negative direction" along the speed trajectory or the position trajectory corresponding to the target speed Vr or the target position Xr.

The speed detector 317 measures a time interval between pulse edges in one of an A-phase signal and a B-phase signal as the pulse signals input from the CR encoder 53. Thereby, the speed detector 317 detects a reciprocal of the measured time interval as an actual speed of the carriage 41 and outputs the reciprocal as the detection speed Vm.

The speed detector 317 outputs a positive value as the detection speed Vm when the carriage 41 moves in the "positive direction". When the carriage 41 moves in the "negative direction", the speed detector 317 outputs a negative value as the detection speed Vm. The detection speed Vm output from the speed detector 317 is input to the subtracter 311 and the command generator 310.

The position detector 319 detects an actual position of the carriage 41 based on the A-phase signal and the B-phase signal input from the CR encoder 53. The actual position of the carriage 41 is output as the detection position Xm.

Particularly, the position detector 319 specifies the moving direction of the carriage 41 from a phase difference between the A-phase signal and the B-phase signal. When the carriage 41 moves in the "positive direction", the position detector 319 updates a counter to a value incremented by 1 each time a pulse edge is detected. When the carriage 41 moves in the "negative direction", the position detector 319 updates the counter to a value decremented by 1 each time a pulse edge is detected. According to such operation, the position detector 319 detects the counter value as the actual position of the carriage 41. The detection position Xm output from the position detector 319 is input to the subtracter 312 and the command generator 310.

Subsequently, a process executed by the command generator 310 is explained by way of FIGS. 7A-7B. FIG. 7A and FIG. 7B are flowcharts showing a conveyance control process executed by the command generator 310 according to a command input from the CPU 11 in S140.

In S140, as noted above, information of the conveyance direction and the target stop position Xe is input to the command generator 310 of the CR motor controller 31 from the CPU 11.

Accordingly, the command generator 310, when starting the conveyance control process shown in FIGS. 7A-7B, sets the target stop position Xe according to the information input from the CPU 11 and also sets a position (Xe q·D) located a predetermined distance D upstream in the conveyance direction of the target stop position Xe to the control changeover position Xc (S210).

The variable q is set to the value "1" when the conveyance direction is the "positive direction", and to the value "1" when the conveyance direction is the "negative direction".

The distance D is predefined as a value not more than the above distance D1 at the design stage so that the control changeover point Xc is set to the image forming end position or downstream in the conveyance direction of the image forming end position.

When the target stop position Xe and the control changeover point Xc are set, the command generator 310 sets the operation mode to a speed control mode (S215). Specifically, the command generator 310 provides a command to the switcher 315 to set such that the manipulated variable Uv output from the speed controller 313 is input to the CR motor driving circuit 51 through the switcher 315.

Thereafter, the target speed Vr=q·fa(t) corresponding to a current time t is output to the speed controller 313 according to a speed command function q·fa(t) for a predetermined acceleration zone, until an acceleration end time Ta arrives (S220). The function fa(t) is a monotone increasing function which defines the target speed Vr from a control start time t=0 to the acceleration end time t=Ta when the conveyance direction is the "positive direction".

When the acceleration end time Ta arrives (S225: Yes), the command generator 310 calculates a difference between the detection position Xm of the carriage 41 obtained from the position detector 319 at the acceleration end time Ta and an acceleration start position Xs (the detection position of the carriage 41 obtained from the position detector 319 at the control start time t=0). Thereby, an acceleration distance Da=|Xm Xs| is calculated (S230). Moreover, a position (Xe q·Da) located the acceleration distance Da upstream in the conveyance direction of the target stop position Xe is set as the deceleration start point Xd (S235).

Thereafter, the command generator 310 outputs to the speed controller 313 a target speed q·Vrc in the constant speed zone as the target speed Vr corresponding to the current time t during a period until the carriage 41 reaches the deceleration start point Xd (i.e., until a conditional expression q·(Xm Xd)≧0 is satisfied), based on the detection position Xm of the carriage 41 obtained from the position detector 319 (S240). The target speed q·Vrc in the constant speed zone is consistent with a target speed q·fa(t=Ta) at the time t=Ta in the acceleration zone.

When the carriage 41 reaches the deceleration start point Xd (S245: Yes), the command generator 310 outputs to the speed controller 313 the target speed Vr=fd(t) corresponding to the current time t according to a speed command function fd(t)=q·fa(Ta(t Td)) for the deceleration zone, during a period from a deceleration start point arriving time Td (i.e., the time Td at which the conditional expression q·(Xm Xd)≧0 is satisfied) till when the carriage 41 arrives at the control changeover point Xc (i.e., the period until the conditional expression q·(Xm Xc)≧0 is satisfied) (S250). The speed command function fd(t) for the deceleration zone is defined by a function q·fa(Ta(t Td)) which has a line-symmetric relation in terms of time with the speed command function q·fa(t) for the acceleration zone.

When it is determined that the carriage 41 has reached the control changeover point Xc based on the detection position Xm of the carriage 41 obtained from the position detector 319 (S255: Yes), the process moves to S270. A position command function fx(t) which defines the target position Xr from a time Tc when the carriage 41 has reached the control changeover point Xc (i.e., the time Tc at which the conditional expression q·(Xm Xd)≧0 is satisfied) till when the carriage 41 arrives at the target stop position Xe is generated. Particularly, the position command function fx(t) is defined according to the following formulae. FIG. 8 is a graph showing the position command function fx(t) defined in S270.

$$fx(t) = A \cdot (t - Te)^2 + Xe \tag{1}$$

$$A = \frac{Xc - Xe}{(Tc - Te)^2} \tag{2}$$

$$Te = Tc + \frac{2(Xe - Xc)}{\frac{Vc}{k}} \tag{3}$$

Here, specifically, the detection speed Vm obtained from the speed detector 317 at the time Tc is expressed as the detection speed Vc.

The deceleration coefficient k is arbitrarily defined by a designer to be not less than 1. For example, the deceleration coefficient k may be set to 1.

When k=1, a value fx'(t=Tc) of a first order temporal differentiation fx'(t) of the position command function fx(t) at the time Tc is the speed Vc. Accordingly, if k is set to k=1, abrupt speed fluctuation of the carriage 41 can be restrained when the control of the carriage 41 is switched to position control at the control changeover point Xc.

In the present embodiment, the position command function fx(t) is defined as a quadratic function in which a first order temporal differentiation at the target stop position Xe is equal to zero. Thus, according to the position control according to the position command function fx(t), the carriage 41 can be stopped at the target stop position Xe with precision.

When the position command function fx(t) is generated in S270, the command generator 310 switches the operation mode to a position control mode (S275). Specifically, the command generator 310 provides a command to the switcher 315 so that the manipulated variable Ux output from the position controller 314 is input to the CR motor driving circuit 51 through the switcher 315.

Thereafter, until a stop time Te defined by the formula (3) arrives, the target position Xr=fx(t) corresponding to the current time t is output to the position controller 314 according to the position command function fx(t) generated in S270 (S280).

When the stop time Te arrives (S285: Yes), Xr=Xe is output to the position controller 314 for a predetermined time as the target position (S290). Then, the present conveyance control process is ended.

Each time the step of S140 is executed by the CPU 11, the command generator 310 executes the conveyance control process as described above. Thereby, as shown in FIG. 5, the command generator 310 forms the target speed trajectory during acceleration and the target speed trajectory during deceleration to be symmetrical in terms of time and makes the acceleration distance and the deceleration distance equal in the image forming area.

Accordingly, in the printer apparatus 1 of the present embodiment, in a zone in which the recording head 23 is shifted to a constant speed state from the image forming start position and in a zone in which the recording head 23 passes the image forming end position from the deceleration start point Xd and further reaches the control changeover point Xc, as shown in the lower part of FIG. 10, the speed trajectories of the recording head 23 can be formed symmetrical with respect to an axis in the speed direction which passes a midpoint between the acceleration end position and the deceleration start point (i.e., a midpoint of a return point upstream and a return point downstream in the conveyance direction), in a two-dimensional coordinate system having position and speed as dimensions. Even if the image forming operation is performed during acceleration/deceleration in each of the outward and homeward journeys, deterioration in image quality due to misalignment of landing positions of ink drops can be suppressed.

According to the present embodiment, the position command function fx(t) is defined by a quadratic function which is a smooth monotone function in which a first order temporal differentiation at the target stop position Xe is equal to zero. The position command function fx(t) is also a monotone increasing function when the conveyance direction is the positive direction and a monotone decreasing function when the conveyance direction is the negative direction. Thus, the recording head 23 can be stopped with precision at the target stop position Xe (return point).

According to the present embodiment, conveyance operation can be achieved which makes the speed trajectories with respect to position of the recording head 23 symmetrical. Deterioration in image quality due to misalignment of landing positions of ink drops can be suppressed. A compact and sophisticated image forming apparatus can be manufactured.

An embodiment of the present invention has been described in the above. However, the present invention should not be limited by the above-described embodiment, and can be practiced in various manners. For example, in the above-described embodiment, when the acceleration distance Da is figured out, the detection position Xm of the carriage 41 obtained from the position detector 319 at the time when the control start time t=0 is set as the acceleration start position Xs. The acceleration distance Da may be figured out using the acceleration start position (the target stop position Xe when the conveyance direction is a reverse direction) defined in design as the acceleration start position Xs. In the present embodiment, the carriage 41 can be stopped at the target stop position Xe with precision. Thus, an equivalent result can be obtained no matter which value is adopted as the acceleration start position Xs.

What is claimed is:

1. An image forming apparatus comprising:

a recording unit configured to eject ink drops;

a conveyance mechanism that conveys the recording unit in a main scanning direction by a driving force of an internal motor;

a position detecting unit that detects the position of the recording unit in a conveyance path;

an image forming control unit that controls the recording unit to eject ink drops during conveyance of the recording unit thereby to form an image onto a sheet passing an ejection position of the ink drops in a sub-scanning direction; and a conveyance control unit that drives the motor to control conveyance of the recording unit, wherein the conveyance control unit is configured to:

reverse the conveyance of the recording unit at a first return point disposed at an upstream end of the conveyance path and a second return point disposed at a downstream end of the conveyance path in the main scanning direction so as to reciprocate the recording unit between the first return point and the second return point, control a speed of the recording unit to a target speed from when the recording unit is at the first return point until the recording unit reaches a predefined control changeover point before the second return point, such that:

the speed of the recording unit is accelerated from the first return point in a conveyance direction;

the recording unit is conveyed in the conveyance direction at a constant speed after acceleration until the recording unit reaches a deceleration start point, wherein a distance between the deceleration start point and the second return point is set to be the same as a distance over which the recording unit is conveyed during the acceleration; and the speed of the recording unit is decelerated after the recording unit has reached the deceleration start point until the recording unit reaches the control changeover point, control a position of the recording unit to a target position after the recording unit has reached the control changeover point, such that the conveyance of the recording unit is decelerated to stop at the second return point, define a constant speed moving area, which is an area in the conveyance path in which the conveyance control unit moves the recording unit at a constant speed, to be a smaller area than an image forming area which is the area in the conveyance path in which image forming operation by the image forming control unit is performed, define the control changeover point to be one of an end point downstream in the conveyance direction of the image forming area and a point downstream in the conveyance direction from the end point, and, set the target speed such that, in an acceleration zone starting from a start point upstream in the conveyance direction of the image forming area to where the recording unit is shifted to a constant speed state and in a deceleration zone starting from the deceleration start point to where the recording unit reaches the end point downstream in the conveyance direction of the image forming area, a speed curve of the recording unit is symmetrical with respect to an axis of a speed direction passing a midpoint between an end point of the acceleration zone and the deceleration start point which is a start point of the deceleration zone, in a two-dimensional coordinate system having position and speed as dimensions.

2. The image forming apparatus according to claim 1, wherein, the conveyance control unit sets the target speed such that, in an acceleration zone in which the recording unit is shifted to a constant speed state from the first return point and in a deceleration zone in which the recording unit reaches the control changeover point from the deceleration start point, a speed curve of the recording unit is symmetrical with respect to the axis of the speed direction which passes a midpoint between an end point of the acceleration zone and a deceleration start point which is a start point of the deceleration zone, in a two-dimensional coordinate system having position and speed as dimensions.

3. The image forming apparatus according to claim 2, wherein the conveyance control unit includes:

a speed detecting unit that detects the speed in the conveyance path of the recording unit;

a first target speed setting unit that sets, according to the target speed curve in which the target speed in an acceleration zone in which the recording unit is accelerated from the first return point to be shifted to a constant speed state and the target speed in a constant speed zone following the acceleration zone are defined, the target speed at each time until the constant speed zone ends;

a first arrival determining unit that determines whether or not the recording unit has reached the deceleration start point based on a detection result of the position detecting unit;

a second target speed setting unit that sets, when it is determined that the recording unit has reached the deceleration start point, the target speed at each time after the recording unit has reached the deceleration start point according to a target speed curve in the deceleration zone indicating a speed curve symmetrical to the target speed curve in the acceleration zone;

a second arrival determining unit that determines whether or not the recording unit has reached the control changeover point which is a point downstream in the conveyance direction of the deceleration start point based on a detection result of the position detecting unit;

a target position setting unit that sets the target position at each time after the recording unit has reached the control changeover point;

a first manipulated variable determining unit that determines a manipulated variable for the motor to reduce a deviation between the target speed and the speed of the recording unit detected by the speed detecting unit, the target speed being set by the first target speed setting unit until the recording unit reaches the deceleration start point from the first return point and by the second target speed setting unit after the recording unit has reached the deceleration start point;

a second manipulated variable determining unit that determines the manipulated variable for the motor to reduce a deviation between the target position set by the target position setting unit and the position of the recording unit detected by the position detecting unit;

a driving unit that inputs a driving signal corresponding to the input manipulated variable to drive the motor; and a switching unit that inputs to the driving unit the manipulated variable determined by the first manipulated variable determining unit until the recording unit reaches the control changeover point from the first return point and the manipulated variable determined by the second manipulated variable determining unit after the recording unit has reached the control changeover point.

4. The image forming apparatus according to claim 3, wherein the conveyance control unit includes an acceleration distance specifying unit that specifies an acceleration distance which is a moving distance of the recording unit required until the recording unit moves into the constant speed state from the first return point based on a detection result of the position detecting unit; and a deceleration start point setting unit that sets the deceleration start point to a point located upstream in the conveyance direction of the recording unit by the acceleration distance specified by the acceleration distance specifying unit from the second return point in the conveyance direction of the recording unit.

5. The image forming apparatus according to claim 3, further comprising:

a target position curve determining unit that defines, based on information of the speed of the recording unit upon arrival to the control changeover point detected by the speed detecting unit and the distance from the control changeover point to the second return point, a target position curve that makes the recording unit stop at the second return point as the target position curve from the control changeover point to the second return point, when it is determined by the second arrival determining unit that the recording unit has reached the control changeover point, wherein the target position setting unit, according to the target position curve defined by the target position curve determining unit, sets the target position at each time after the recording unit has reached the control changeover point.

6. The image forming apparatus according to claim 5, wherein the target position curve determining unit defines an internal parameter of a given function having time as an input variable and the target position as an output variable to be a smooth monotone function in which a first order temporal differentiation at the second return point is equal to zero, based on the speed of the recording unit upon arrival to the control changeover point and a distance to the second return point.

7. The image forming apparatus according to claim 6, wherein the given function is a quadratic function in which a first order temporal differentiation at the second return point is equal to zero.

8. The image forming apparatus according to claim 5, wherein the target position curve determining unit defines an internal parameter of a given function having time as an input variable and the target position as an output variable to be a smooth monotone function in which a first order temporal differentiation at the second return point is equal to zero and a first order temporal differentiation at the control changeover point is consistent with the speed of the recording unit upon arrival to the control changeover point, based on the speed of the recording unit upon arrival to the control changeover point and a distance to the second return point.

9. The image forming apparatus according to claim 1, wherein the conveyance control unit sets the target position such that a target position trajectory curve with respect to time is a smooth monotone function in which a first order temporal differentiation at the second return point is equal to zero.

10. The image forming apparatus according to claim 9, wherein the conveyance control unit sets the target position such that a target position curve with respect to time is a quadratic function, which is the smooth monotone function, in which a first order temporal differentiation at the second return point is equal to zero.

11. The image forming apparatus according to claim 1, wherein the conveyance control unit sets the target position such that a target position curve with respect to time is a smooth monotone function in which a first order temporal differentiation at the second return point is equal to zero and a first order temporal differentiation at the control changeover point is consistent with the speed of the recording unit upon arrival to the control changeover point.

12. An image forming apparatus comprising:

a recording unit configured to eject ink drops;

a conveyance mechanism that conveys the recording unit in a main scanning direction by a driving force of an internal motor;

a position detecting unit that detects the position of the recording unit in a conveyance path;

an image forming control unit that controls the recording unit to eject ink drops during conveyance of the recording unit thereby to form an image onto a sheet passing an ejection position of the ink drops in a sub-scanning direction; and a conveyance control unit that drives the motor to control conveyance of the recording unit, wherein the conveyance control unit is configured to:

reverse the conveyance direction of the recording unit at a first return point disposed at an upstream end of the conveyance path and a second return point disposed of at a downstream end of the conveyance path in the main scanning direction so as to reciprocate the recording unit between the first return point and the second return point, control a speed of the recording unit to a target speed from when the recording unit is at the first return point until the recording unit reaches a predefined control changeover point before the second return point, such that:

the speed of the recording unit is accelerated from the first return point in a conveyance direction;

the recording unit is conveyed in the conveyance direction at a constant speed after acceleration until the recording unit reaches a deceleration start point, wherein a distance between the deceleration start point and the second return point is set to be the same as a distance over which the recording unit is conveyed during the acceleration; and the speed of the recording unit is decelerated after the recording unit has reached the deceleration start point until the recording unit reaches the control changeover point, control a position of the recording unit to a target position after the recording unit has reached the control changeover point, such that the conveyance of the recording unit is decelerated to stop at the second return point, define a constant speed moving area, which is an area in the conveyance path in which the conveyance control unit moves the recording unit at a constant speed, to be a smaller area than an image forming area which is the area in the conveyance path in which image forming operation by the image forming control unit is performed, define the control changeover point to be one of an end point downstream in the conveyance direction of the image forming area and a point downstream in the conveyance direction from the end point, set the target speed such that, in an acceleration zone starting from a start point upstream in the conveyance direction of the image forming area to where the recording unit is shifted to a constant speed state and in a deceleration zone starting from the deceleration start point to where the recording unit reaches the end point downstream in the conveyance direction of the image forming area, a speed curve of the recording unit is symmetrical with respect to an axis of a speed direction passing a midpoint between an end point of the acceleration zone and the deceleration start point which is a start point of the deceleration zone, in a two-dimensional coordinate system having position and speed as dimensions, and, sets the target position such that a target position curve with respect to time is a smooth monotone function in which a first order temporal differentiation at the control changeover point is consistent with the speed of the recording unit upon arrival to the control changeover point.

* * * * *